United States Patent [19]

Rea et al.

[11] 4,183,278

[45] Jan. 15, 1980

[54] DRIVER CIRCUIT FOR TONE GENERATOR

[75] Inventors: Irvin B. Rea, Royal Oak; Michael Slavin, Troy, both of Mich.

[73] Assignee: Lectron Products, Inc., Troy, Mich.

[21] Appl. No.: 5,394

[22] Filed: Jan. 22, 1979

Related U.S. Application Data

[63] Continuation of Ser. No. 842,580, Oct. 17, 1977, abandoned.

[51] Int. Cl.[2] ..... G08B 3/10; G10H 5/10

[52] U.S. Cl. ..... 84/1.24; 340/384 E; 331/56; 332/15; 307/261; 307/265

[58] Field of Search ..... 84/1.01, 1.24, 402, 84/406; 340/384 E, 392; 331/56; 58/13; 332/14, 15; 307/261, 265

[56] References Cited

U.S. PATENT DOCUMENTS

| | | | |
|---|---|---|---|
| 3,137,846 | 6/1964 | Keeling | 340/384 E |
| 3,460,136 | 8/1969 | Jumbazian | 340/384 E |
| 3,518,558 | 6/1970 | Miller | 307/261 |
| 3,579,233 | 5/1971 | Raschke | 340/384 E |
| 3,714,470 | 1/1973 | Goldberg | 307/261 |
| 3,995,268 | 11/1976 | Ferrari | 340/384 E |
| 4,012,702 | 3/1977 | Weber | 340/384 E |

*Primary Examiner*—Gene Z. Rubinson
*Assistant Examiner*—William L. Feeney
*Attorney, Agent, or Firm*—Harness, Dickey & Pierce

[57] ABSTRACT

A driver circuit for a tone generator that is adapted to cause the tone generator to produce a pleasant sounding chime. The circuit comprises high and low frequency oscillator circuits whose decaying sawtooth type outputs are summed and modulated to produce the desired chime effect.

17 Claims, 2 Drawing Figures

DRIVER CIRCUIT FOR TONE GENERATOR

This is a continuation, of application Ser. No. 842,580, filed Oct. 17, 1977, now abandoned.

BACKGROUND AND SUMMARY OF THE INVENTION

The present invention relates to a driver circuit for a coil type tone generator that is effective to cause the tone generator to produce a pleasant sounding chime. The circuit is particularly that it is simple and inexpensive to manufacture, and is relatively immune to the effects of extraneous electrical devices.

In general, the circuit includes a high frequency oscillator and a low frequency oscillator. The high frequency oscillator established the tone of the chime and the low frequency oscillator provides the "striking" rate of the chime. The oscillators comprise simple logic gate circuits which are adapted to produce a decaying sawtooth type signal. The outputs from the two oscillators are combined so that the high frequency signal is superimposed onto the low frequency signal. The resulting signal is then pulse width modulated by providing the same through a logic gate. The modulated square wave signal is supplied to the base of a driver transistor which controls the excitation of the coil. The effect of modulating the signal is to cause the transistor to cycle on and off with the percent on-time of the transistor varying in accordance with the duty cycle of the waveform. Thus, as the duty cycle of the signal rapidly increases and gradually decreases, the tone generator produces a chime and decay, chime and decay.

Further objects and advantages of the present invention will become apparent from a reading of the detailed description of the preferred embodiment which makes reference to the following set of drawings in which:

DETAILED DESCRIPTION OF THE PREFERRED EMBODIMENT

Figure 1:
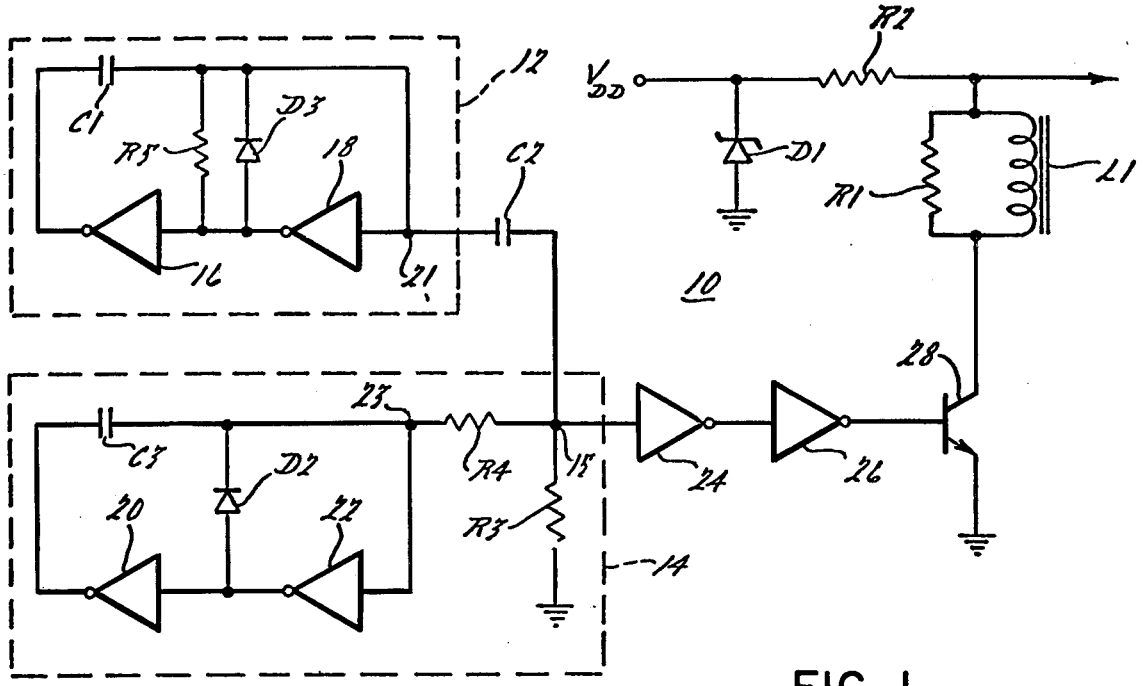
FIG. 1 is a circuit diagram of a driver circuit according to the present invention.

Referring to FIG. 1, a circuit diagram of a driver circuit 10 according to the present invention is shown. The present invention is adapted to be used in combination with a coil driven tone generator such as that described in copending U.S. application, Ser. No. 814,417, filed July 11, 1977, entitled "Tone Generator and Control Circuit Therefor", assigned to the assignee of the present application. In general, the driver circuit 10 comprises a high frequency oscillator 12 and a low frequency oscillator 14 whose outputs are combined at node 15 and provided to the base of a driver transistor 28 which has its output terminals connected in series with the coil L1 between a voltage source $V_{DD}$ and ground. The combination of the high frequency and low frequency oscillator circuits, 12 and 14 respectively, causes the tone generator to produce a chime type of audio output, rather than a steady tone. In particular, the high frequency oscillator 12 develops the tone of the audio output, and the low frequency oscillator 14 provides the rate at which the chime "strikes". Thus, the audio output produced by the tone generator comprises a pleasant sounding repetitive chime and decay, chime and decay.

The high frequency oscillator 12 comprises a pair of logic gates, herein inverters 16 and 18, connected in series, with a capacitor C1 connected in the feedback loop of the oscillator 12. A resistor R5 and a diode D3 are connected in parallel between the midpoint of logic gates 16 and 18 and the feedback loop. The values of resistor R5 and capacitor C1 are selected in the preferred embodiment so that oscillator 12 oscillates at a frequency of approximately 1000Hz.

The low frequency oscillator 14 also comprises a pair of inverter logic gates 20 and 22 connected in series, with a capacitor C3 connected in the feedback loop of the oscillator 14. A diode D2 is tied between the feedback loop and the midpoint of the two inverters 20 and 22, and a pair of series resistors R3 and R4 are connected between the input of the oscillator 14 and ground. The values of resistors R3 and R4 and capacitor C3 are selected in the preferred embodiment so that oscillator 14 oscillator at a frequency of approximately 1.2 Hz.

Since both oscillator circuits 12 and 14 function in the same manner, only the operation of the high frequency oscillator 12 will be described. The feedback capacitor C1, which causes the circuit to oscillate, is adapted to be charged in one direction through diode D3 and in the other direction through resistor R5. Since resistor R5 offers substantially greater resistance than diode D3, the capacitor C1 will rapidly charge positive through diode D3 and slowly decay negatively through resistor R5. Accordingly, the signal at input node 21 will have a sawtooth type waveform with an exponentially decaying negative slope portion and a short positive slope portion. Importantly, it will be noted that the "output" signal from oscillator 12 is actually taken off the input 21 of the oscillator 12. The significance of this feature will subsequently become apparent from the description of the remainder of the circuit 10.

In the low frequency oscillator circuit 14, the series equivalent of resistors R3 and R4 serve the same function as resistor R5 in the high frequency oscillator circuit 12. The resistors R3 and R4, however, are located in a different position in the circuit, (although with respect to oscillator 14, their effect remains the same), because it is necessary to step-down the voltage applied to inverter 24. Thus, the required circuit resistance for oscillator 14 is split between a pair of resistors R3 and R4 with the "output" from the oscillator taken off the midpoint of the voltage divider network. As noted, the two oscillator circuits 12 and 14 function in a similar manner. Thus, the signal at input node 23 of oscillator 14 also comprises a sawtooth type waveform with an exponentially decaying negative-going portion and a short positive-going portion.

Figure 2:
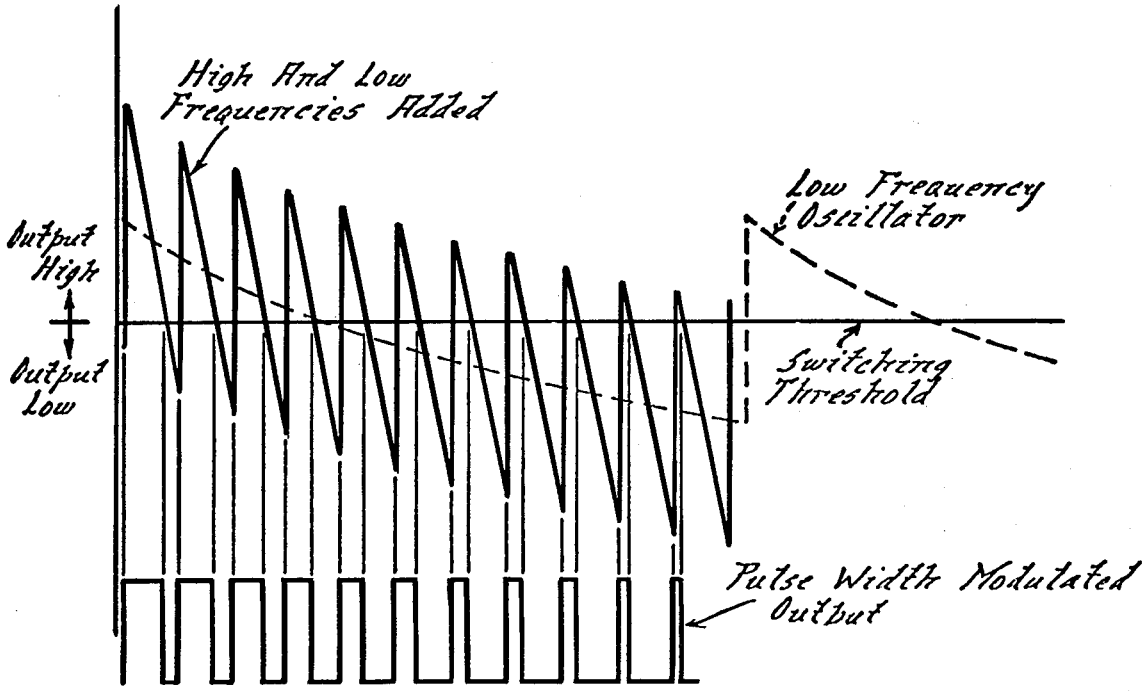
FIG. 2 is a signal diagram illustrating the manner in which the combined waveform is pulse width modulated.

The "outputs" from the two oscillator circuits 12 and 14 are summed at node 15; the signal from the high frequency oscillator 12 being a.c. coupled through capacitor C2 in order to isolate the high frequency oscillator 12 from the low frequencies of oscillator 14. By summing the two signals, the high frequency waveform is effectively superimposed onto the low frequency waveform as illustrated in FIG. 2. It will be appreciated that the signal diagram, for reasons of clarity, does not present an accurate representation of the relative frequency difference between the two oscillator signals.

The combined signal at node 15 is applied to a logic switching element herein an inverter 24, which performs the pulse with modulation function. Specifically, inverter 24 has associated therewith a particular switching level between 2 volts and 3 volts, typically around 2.5 volts, which controls the logic state of its output. In particular, if the magnitude of the input signal is greater than the switching level of inverter 24, the output of inverter 24 will assume a logical LO state; i.e., 0 volts. Conversely, whenever the magnitude of the input signal is less than the switching level of inverter 24, the output of inverter 24 will switch to a logical III state; i.e. 5 volts. Thus, as illustrated in FIG. 2, the inverter 24 acts as a pulse width modulator by providing a pulsed output signal whose pulse width is approximately proportional to the instantaneous magnitude of the decaying sawtooth type signal at node 23. In actuality, the signal diagram in FIG. 2 representing the output of inverter 26 rather than inverter 24. Inverter 26 merely inverts the output of inverter 24 and is included simply because it comprises the sixth logic gate in the IC package and permits the use of an NPN driver transistor 28 rather than a more expensive PNP type. Accordingly, the signal provided to the base of transistor 28 comprises a pulsed signal whose pulse widths diminish as the magnitude of the decaying sawtooth type waveform at node 15 decreases. Thus, driver transistor 28 is caused to cycle on and off, with its percentage on time being determined by the duty cycle of the signal provided to its base. The effect of driving the coil L1 in this manner is as noted to cause the tone generator to produce a cyclic chime and decay audio output; the frequency of the low frequency oscillator determining the rate of the chime and the frequency of the high frequency oscillator determining the tone of the chime.

At this point, the significance of connecting the oscillators 12 and 14 so that the "output" signals are taken off the inputs will now be explained. From the diagram in FIG. 2, it is apparent that a decaying ramp signal of the type appearing at summing node 15 is necessary in order for the inverter 24 to provide its modulating function. However, the signals at the conventional outputs of oscillators 12 and 14, at the outputs of inverters 16 and 20, respectively, comprise square wave pulse signals which are effectively integrated by the feedback capacitors C1 and C3 to develop the decaying ramp signals present at the oscillator inputs 21 and 23. Thus, it can be seen that if the oscillators 12 and 14 were connected in the conventional manner so that the output pulse signals were summed and provided to inverter 24, the inverter 24 would simply invert the pulses rather than modulate the signal. Consequently, the desired chime effect would be lost.

While the above description constitutes the preferred embodiment of the invention, it will be appreciated that the invention is susceptible to modification, variation and change without departing from the proper scope or fair meaning of the accompanying claims.

What is claimed is:

1. A driver circuit for a noise generator that is adapted to cause said noise generator to produce a chime type of audio output comprising:

first oscillator means for producing a relatively high frequency signal having a decaying amplitude characteristic;

second oscillator means for producing a relatively low frequency signal having a decaying amplitude characteristic;

summing means for combining said high and low frequency signals;

modulating means connected to said summing means for producing a pulse width modulated substantially square wave signal from said combined signal at a frequency related to the frequency of said high frequency signal and having a duty cycle that varies in accordance with the amplitude of said low frequency signal; and driver means connected to said noise generator for driving said noise generator in accordance with said modulated signal.

2. The driver circuit of claim 1 wherein said second oscillator means is adapted to produce a signal having a substantially sawtooth type waveform.

3. The driver circuit of claim 2 wherein said first oscillator means is adapted to produce a signal having a substantially sawtooth type waveform.

4. The driver circuit of claim 3 wherein said first and second oscillator means are adapted to produce substantially square wave signals at their conventional outputs and said substantially sawtooth type waveform signals at their conventional inputs, and further wherein said summing means is connected to the conventional inputs of said first and second oscillator means.

5. The driver circuit of claim 3 wherein said modulating means comprises a logic gate.

6. The driver circuit of claim 5 wherein said logic gate comprises an inverter.

7. The driver circuit of claim 1 wherein said driver means comprises a solid state switching element that is connected in series with said noise generator and is adapted to cycle from a conductive state to a nonconductive state in accordance with the duty cycle of said modulated signal.

8. A driver circuit for a noise generator that is adapted to cause said noise generator to produce a chime type audio output comprising:

first oscillator means for producing a relatively high frequency signal having a substantially sawtooth type waveform;

second oscillator means for producing a relatively low frequency signal having a substantially sawtooth type waveform;

summing means connected to said first and second oscillator means for combining said high and low frequency signals;

logic gate means connected to said summing means for producing a pulse width modulated substantially square wave signal from said combined signal at the frequency of said high frequency signal and having a duty cycle that varies in accordance with the amplitude of said low frequency signal; and driver circuit means connected in circuit with said noise generator for driving said noise generator in accordance with the varying duty cycle of said modulated signal.

9. The driver circuit of claim 1 wherein the frequency of said pulse width modulated signal is equal to the frequency of said high frequency signal.

10. A driver circuit for a tone generator that is adapted to cause said tone generator to produce a chime type audio output, including:

first circuit means for producing a relatively high frequency signal having a decaying amplitude characteristic;

second circuit means for causing said relatively high frequency signal to vary according to a relatively low frequency pattern having a decaying amplitude characteristic; and third circuit means for producing a pulse width modulated substantially square wave drive signal at a frequency related to said relatively high frequency signal and having a duty cycle that varies in accordance with the amplitude characteristic of said relatively low frequency pattern.

11. The driver circuit of claim 10 wherein said pulse width modulated signal comprises a digital square wave signal having either a logic HI amplitude level or a logic LO amplitude level.

12. The driver circuit of claim 11 wherein said second circuit means includes an oscillator circuit for producing a signal at said relatively low frequency.

13. The driver circuit of claim 12 wherein said relatively low frequency signal produced by said oscillator circuit has a decaying amplitude characteristic.

14. The driver circuit of claim 13 wherein said second circuit means further includes means for combining said relatively low frequency signal and said relatively high frequency signal such that said relatively high frequency signal is effectively superimposed onto said relatively low frequency signal.

15. The driver circuit of claim 10 wherein said third circuit means includes a transistor having its collector and emitter terminals connected between said tone generator and ground potential.

16. The driver circuit of claim 15 wherein said third circuit means further includes logic gating means connected to the output of said second circuit means.

17. The driver circuit of claim 16 wherein the output of said logic gating means is connected to the base of said transistor.

* * * * *

UNITED STATES PATENT AND TRADEMARK OFFICE

CERTIFICATE OF CORRECTION

PATENT NO. : 4,183,278

DATED : January 15, 1980

INVENTOR(S) : Irvin B. Rea and Michael Slavin

It is certified that error appears in the above–identified patent and that said Letters Patent are hereby corrected as shown below:

Column 1, line 12, after "particularly" insert --suited for use in combination with an automotive tone generator--.

Column 1, line 17, "established" should be --establishes--.

Column 2, line 21, second occurrence of "oscillator" should be --oscillates--.

Column 3, line 10, "III" should be --HI--.

Column 3, line 16, "representing" should be --represents--.

Column 1, line 53, after "1977" insert -- , now abandoned --.

Signed and Sealed this

*Twentieth* Day of *May 1980*

[SEAL]

*Attest:*

SIDNEY A. DIAMOND

*Attesting Officer*

*Commissioner of Patents and Trademarks*